US007387465B2

(12) United States Patent
Hall et al.

(10) Patent No.: US 7,387,465 B2
(45) Date of Patent: Jun. 17, 2008

(54) APPARATUS, SYSTEM, AND METHOD FOR DEGRADING AND REMOVING A PAVED SURFACE

(76) Inventors: David R. Hall, 2185 S. Larsen Pkwy., Provo, UT (US) 84606; Joe Fox, 2185 S. Larsen Pkwy., Provo, UT (US) 84606

( * ) Notice: Subject to any disclaimer, the term of this patent is extended or adjusted under 35 U.S.C. 154(b) by 495 days.

(21) Appl. No.: 11/162,435

(22) Filed: Sep. 9, 2005

(65) Prior Publication Data

US 2006/0198697 A1 Sep. 7, 2006

Related U.S. Application Data

(63) Continuation-in-part of application No. 11/070,411, filed on Mar. 1, 2005, now Pat. No. 7,223,049.

(51) Int. Cl.
*E01C 23/09* (2006.01)

(52) U.S. Cl. ..... 404/94; 404/93

(58) Field of Classification Search ..... 404/93, 404/94

See application file for complete search history.

(56) References Cited

U.S. PATENT DOCUMENTS

| | | | | |
|---|---|---|---|---|
| 3,361,042 | A | 1/1968 | Cutler | |
| 3,732,023 | A | 5/1973 | Rank | |
| 3,970,404 | A | 7/1976 | Benedetti | |
| 3,989,401 | A | 11/1976 | Moench | |
| 4,018,540 | A | 4/1977 | Jackson | |
| 4,104,736 | A | 8/1978 | Mendenhall | |
| 4,124,325 | A | 11/1978 | Cutler | |
| 4,172,679 | A | 10/1979 | Wirtgen | |
| 4,195,946 | A | 4/1980 | Swisher | |
| 4,335,975 | A | 6/1982 | Schoelkopf | |
| 4,347,016 | A | 8/1982 | Sindelar | |
| 4,407,605 | A | 10/1983 | Wirtgen | |
| 4,453,856 | A | 6/1984 | Chiostri | |
| 4,473,320 | A | 9/1984 | Register | |
| 4,534,674 | A | 8/1985 | Cutler | |
| 4,594,022 | A | 6/1986 | Jeppson | |
| 4,668,017 | A | 5/1987 | Petersen | |
| 4,676,689 | A | 6/1987 | Yant | |
| 4,784,518 | A | 11/1988 | Cutler | |
| 4,793,730 | A | 12/1988 | Butch | |
| 4,795,217 | A * | 1/1989 | Hilaris | 299/36.1 |
| 4,894,959 | A * | 1/1990 | Hoover | 451/38 |
| 4,968,101 | A | 11/1990 | Bossow | |
| 5,026,432 | A * | 6/1991 | Johnson | 134/21 |
| 5,116,162 | A * | 5/1992 | Burhite | 404/72 |
| 5,167,215 | A * | 12/1992 | Harding, Jr. | 125/13.01 |
| 5,366,320 | A | 11/1994 | Hanlon | |
| 5,433,032 | A * | 7/1995 | Bath et al. | 37/407 |

(Continued)

*Primary Examiner*—Raymond W Addie
(74) *Attorney, Agent, or Firm*—Daniel P. Nelson; Tyson J. Wilde

(57) ABSTRACT

An apparatus for degrading and removing a paved surface is disclosed in one aspect of the invention as including a vehicle to travel across a paved surface, a pavement degradation tool coupled to the vehicle and adapted to degrade the paved surface while rotating about an axis substantially normal to the paved surface, and a vacuum device coupled to the vehicle and adapted to remove pavement fragments produced by the pavement degradation tool. The vacuum device may include several intake channels to draw in the degraded pavement fragments. In selected embodiments, these intake channels may be connected to two or more independently moveable banks.

10 Claims, 11 Drawing Sheets

U.S. PATENT DOCUMENTS

| | | | | | |
|---|---|---|---|---|---|
| 5,556,225 | A | | 9/1996 | Marino | |
| 5,564,408 | A | * | 10/1996 | Bassols | 125/12 |
| 5,588,230 | A | * | 12/1996 | Bath et al. | 37/190 |
| 5,765,926 | A | | 6/1998 | Knapp | |
| 5,791,814 | A | | 8/1998 | Wiley | |
| 5,851,086 | A | * | 12/1998 | Kurasako | 404/94 |
| 6,158,920 | A | | 12/2000 | Malot | |
| 6,371,689 | B1 | | 4/2002 | Wiley | |
| 6,503,125 | B1 | * | 1/2003 | Harrington | 451/28 |
| 6,536,422 | B1 | * | 3/2003 | Zuzelo et al. | 125/13.01 |
| 6,536,442 | B2 | * | 3/2003 | St. Charles et al. | 131/194 |
| 6,623,207 | B2 | | 9/2003 | Grubba | |
| 6,769,836 | B2 | | 8/2004 | Llyod | |
| 6,877,930 | B2 | * | 4/2005 | Stromdahl et al. | 404/75 |
| 7,244,077 | B2 | * | 7/2007 | Lee et al. | 404/75 |

* cited by examiner

APPARATUS, SYSTEM, AND METHOD FOR DEGRADING AND REMOVING A PAVED SURFACE

RELATED APPLICATIONS

This patent application is a continuation-in-part of U.S. patent application Ser. No. 11/070,411 filed on Mar. 1, 2005, now U.S. Pat. No. 7,223,049 and entitled Apparatus, System, and Method for Directional Degradation of a Paved Surface, which is herein incorporated by reference in its entirety.

BACKGROUND OF THE INVENTION

1. Field of the Invention

The present invention relates to road reconstruction equipment, more particularly, to apparatus, systems, and methods for degrading and removing a paved surface.

2. Background

Since their debut in the late 1960s and early 1970s, asphalt milling machines have been considered one of the major innovations in road reconstruction. Asphalt milling machines were originally designed to remove a top layer of deteriorated asphalt so a new layer of asphalt could be overlaid on the exposed underlayer. The resulting pavement was superior to simply overlaying a new layer of asphalt directly onto the old and deteriorated asphalt.

One significant benefit of asphalt milling machines that has emerged modernly is the ability to break up asphalt into recyclable-sized fragments. As recycling of all types has become more popular, asphalt milling machines have similarly increased in popularity. In fact, combination milling and paving machines have been developed to mill or break up the old road surface, mix it with new binder, and lay it down to create a new or recycled road surface in one continuous process.

The core component of most modern asphalt milling machines is the cutting drum. Most cutting drums incorporate numerous cutting teeth, coupled to the rounded surface of the drum, to cut or tear into the road surface. The rotational axis of the drum is positioned parallel to the road surface and the drum is rotated while being driven along the road surface in a direction transverse to its axis of rotation. Conventional cutting drums mill the asphalt in an upward direction, or an "up-cut" direction. However, some cutting drums may permit "down-cutting" to control "slabbing," facilitate pulverizing and mixing, and effectively mill pavement over a wet base. Most cutting drums range in width from 12 to 150 inches and generally have a maximum cutting depth of 4 to 16 inches.

Due to the abrasive nature of pavement, the cutting teeth have traditionally been prone to wear out quickly and require frequent replacement. The replacement process may create significant downtime and hinder the overall efficiency of the milling process. For example, early cutting drums had cutting teeth that were welded to the drum. Tooth replacement required cutting the old teeth from the drum and welding new teeth in their place. Consequently, considerable effort has been expended to accelerate the replacement process and to increase the durability of the cutting teeth. Many newer cutting teeth, for example, are coupled to the cutting drum using various bolt-on housings to enable faster replacement.

One shortcoming of current asphalt milling machines is their failure to capitalize on cutting-edge technology used in other industries, such as the downhole drilling industry. For example, numerous technological improvements in polycrystalline diamond compact (PDC) bits, which were introduced in the oil and gas industry in the mid 1970s, have enabled PCD bits to capture a growing share of the downhole drill bit market. Some estimates show that between 2000 and 2003, the total footage drilled with PDC bits increased from 26% in 2000 to 50% in 2003. The total revenue generated by PDC bit sales was approximately $600 million in 2003.

Various recent improvements in PDC bit hydraulics, PDC cutter toughness and abrasion-resistance, and PDC bit dynamic stability have resulted in continuous and significant increases in the average rate of penetration (ROP) and bit life of PDC bits, thereby extending the application of PDC bits into harder and more abrasive formations. In some cases, a single PDC bit may drill 20,000 feet or more without replacement. As a result, a PCD bit may save as much as $1 million per well in time-critical drilling applications. It would be a significant advance if drill bit improvements in the downhole drilling industry could be applied to the road reconstruction industry, where downtime and replacement costs incur significant expense.

Accordingly, what are needed are apparatus and methods for incorporating drill bit and other advances of the downhole drilling industry into road reconstruction equipment. More particularly, apparatus and methods are needed to incorporate PCD and other drill bit advances into asphalt milling, grinding, and cutting equipment. Further needed are novel supplemental and auxiliary systems, such as vacuum devices, to work in conjunction such apparatus and methods, to facilitate the removal, processing, and deposit of asphalt and other pavement materials.

SUMMARY OF THE INVENTION

Consistent with the foregoing, and in accordance with the invention as embodied and broadly described herein, an apparatus for degrading and removing a paved surface is disclosed in one aspect of the present invention as including a vehicle to travel across a paved surface, a pavement degradation tool coupled to the vehicle and adapted to degrade the paved surface while rotating about an axis substantially normal to the paved surface, and a vacuum device coupled to the vehicle and adapted to remove pavement fragments produced by the pavement degradation tool. The vacuum device may include several intake channels to draw in the degraded pavement fragments. In selected embodiments, these intake channels may be connected to two or more independently moveable banks.

In certain embodiments, a shroud may be connected to one or more of the intake channels to improve the seal between the pavement fragments and the intake channels, thereby increasing the suction exerted on the pavement fragments. In other embodiments, the shroud may cover the pavement degradation tool to enable the pavement fragments to be drawn into the intake channels immediately upon breaking away from the pavement. In yet other embodiments, an input channel may be connected to the shroud to provide positive pressure inside the shroud, thereby urging the pavement fragments into the intake channels.

To improve the collection of pavement fragments, the vacuum device may optionally include a scoop element to scoop the pavement fragments into one or more of the intake channels, a roller comprising a series of vanes to rotate over the pavement fragments and direct the pavement fragments into the intake channels, or a bristled roller adapted to brush the pavement fragments into the intake channels.

In another aspect of the invention, a multi-vehicle system for degrading and removing a paved surface includes a first vehicle to travel across a paved surface. A pavement degradation tool is coupled to the first vehicle and is adapted to degrade the paved surface while rotating about an axis substantially normal to the paved surface. A second vehicle is provided to follow the first motorized vehicle and includes a vacuum device adapted to remove pavement fragments produced by the pavement degradation tool.

In yet another aspect of the invention, a method for degrading and removing a paved surface includes directing a pavement degradation tool across a paved surface, wherein the pavement degradation tool is adapted to degrade the paved surface while rotating about an axis substantially normal to the paved surface, and removing pavement fragments produced by the pavement degradation tool using a vacuum device.

The present invention provides novel apparatus, systems, and methods for degrading and removing a paved surface. The features and advantages of the present invention will become more fully apparent from the following description and appended claims, or may be learned by the practice of the invention as set forth hereinafter.

BRIEF DESCRIPTION OF THE DRAWINGS

In order to describe the manner in which the above-recited features and advantages of the present invention are obtained, a more particular description of apparatus and methods in accordance with the invention will be rendered by reference to specific embodiments thereof, which are illustrated in the appended drawings. Understanding that these drawings depict only typical embodiments of the present invention and are not, therefore, to be considered as limiting the scope of the invention, apparatus and methods in accordance with the present invention will be described and explained with additional specificity and detail through the use of the accompanying drawings in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment in accordance with the present invention. Thus, use of the phrases "in one embodiment," "in an embodiment," and similar language throughout this specification may, but does not necessarily, all refer to the same embodiment.

Furthermore, the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

In the following description, numerous specific details are disclosed to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

In this application, "pavement" or a "paved surface" refers to any artificial, wear-resistant surface that facilitates vehicular, pedestrian, or other form of traffic. Pavement may include composites containing oil, tar, tarmac, macadam, tarmacadam, asphalt, asphaltum, pitch, bitumen, minerals, rocks, pebbles, gravel, sand, polyester fibers, Portland cement, petrochemical binders, or the like. Reference in this application to one of "polycrystalline diamond" and "cubic boron nitride" is reference to the other. Likewise, the term "degrade" is used in this application to mean milling, grinding, cutting, ripping apart, tearing apart, or otherwise taking or pulling apart a pavement material into smaller constituent pieces.

Figure 1:
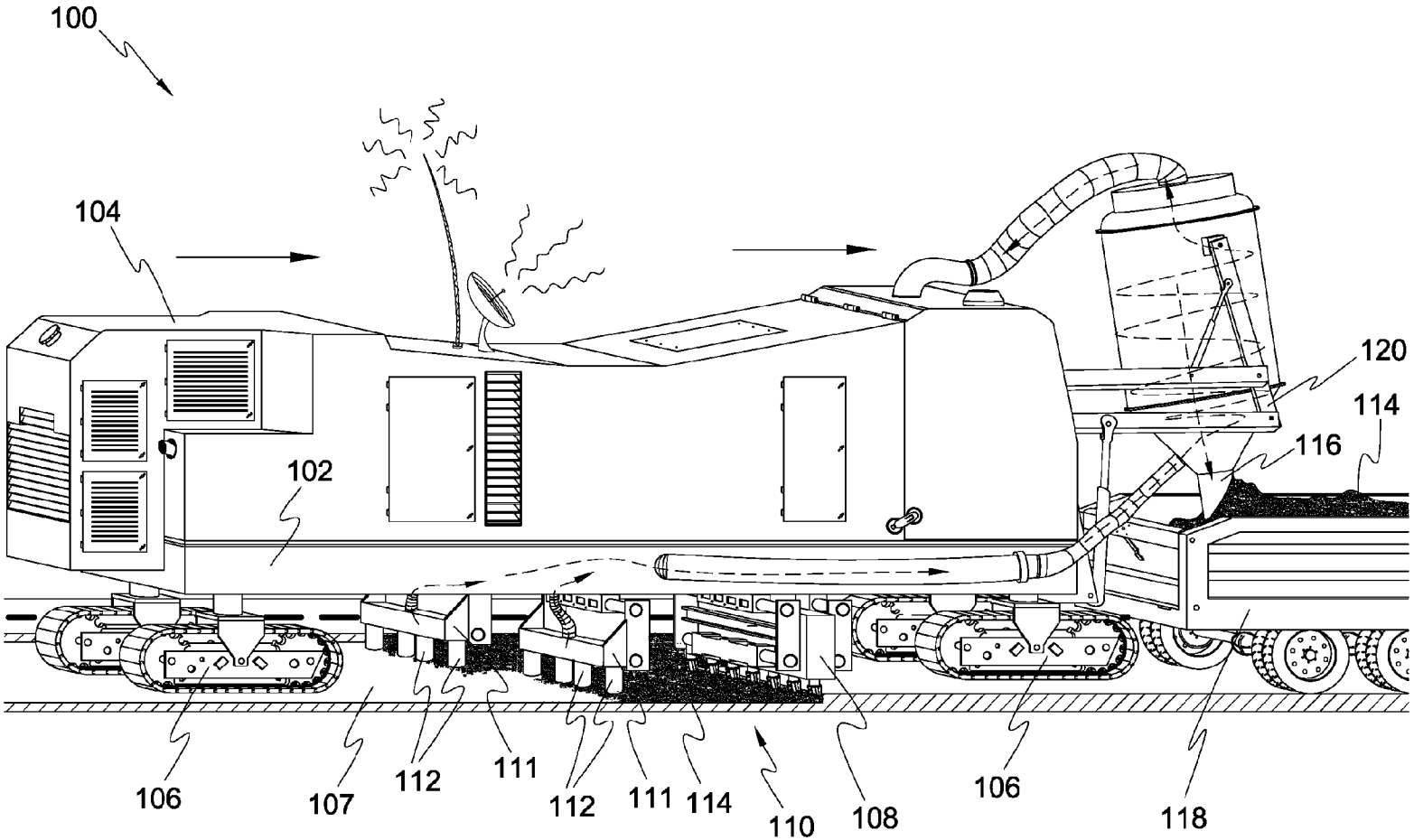
FIG. 1 is perspective view illustrating one embodiment of a pavement degradation and removal apparatus incorporating a vacuum device in accordance with the invention.

Referring to FIG. 1, one contemplated embodiment of an apparatus 100 for degrading and removing a paved surface is illustrated. As shown, an apparatus 100 may include a frame 102, a shroud 104 or cover 104 enclosing various internal component of the apparatus 100, and a translation mechanism 106, such as tracks, wheels, or the like, to translate the apparatus 100 along a surface 107. The translation mechanism 106 may include several sets of tracks, for example, which may be vertically adjusted with respect to the frame 102 to adjust the slant or elevation of the apparatus 100, and to adjust for varying elevations, slopes, and contours of the underlying road surface 107.

The apparatus 100 may include one or more banks 108 of degradation tools 1110, as will be discussed in more detail in the description associated with FIG. 3, and one or more banks 111 of vacuum intake channels 112 to draw in by suction the pavement fragments 114 generated by the pavement degradation tools 110. In certain embodiments, the banks 108, 111 may be actuated independently and may be extended or retracted in a transverse direction with respect to the frame 102 to adjust for variations in the road width, to avoid obstacles, or to traverse a greater or smaller width of the road surface 107, as desired. In selected embodiments, the banks 108, 111 may be as wide as the vehicle itself. Thus, when fully extended from each side of the apparatus 100, the banks 108, 111 may sweep over a road width that is approximately twice the width of the apparatus 100. In other embodiments, each of the vacuum intake channels 112 of each bank 111 may be independently actuated, such as in an up or down direction, to avoid obstacles such as manholes, curbs, or the like, as will be described in additional detail in the description associated with FIG. 5. In certain embodiments, the banks 111 may be oscillated from side-to-side with respect to the apparatus 100 to more effectively pick up pavement fragments 114 located on the road surface 107.

The apparatus 100 may include an outlet 116 to expel pavement fragments 114 gathered by the apparatus 100. The outlet 116 may be positioned such that the pavement fragments 114 are deposited in a transport vehicle 118, such as a dump truck. In selected embodiments, the position of the outlet 116 may be adjusted up or down, front-to-back, or side-to-side by a positioning mechanism 120, as needed, to adjust for differences in height or location of a transport vehicle 118. The apparatus 100 may also take advantage of various control systems used in modern asphalt mills, grinders, and cutters, to provide manual or automated control of the apparatus 100, including but not limited to elevation, speed, steering, cut depth, and leveling controls. These controls may employ various feedback systems and sensors located at a variety of locations around the apparatus 100.

Figure 2:
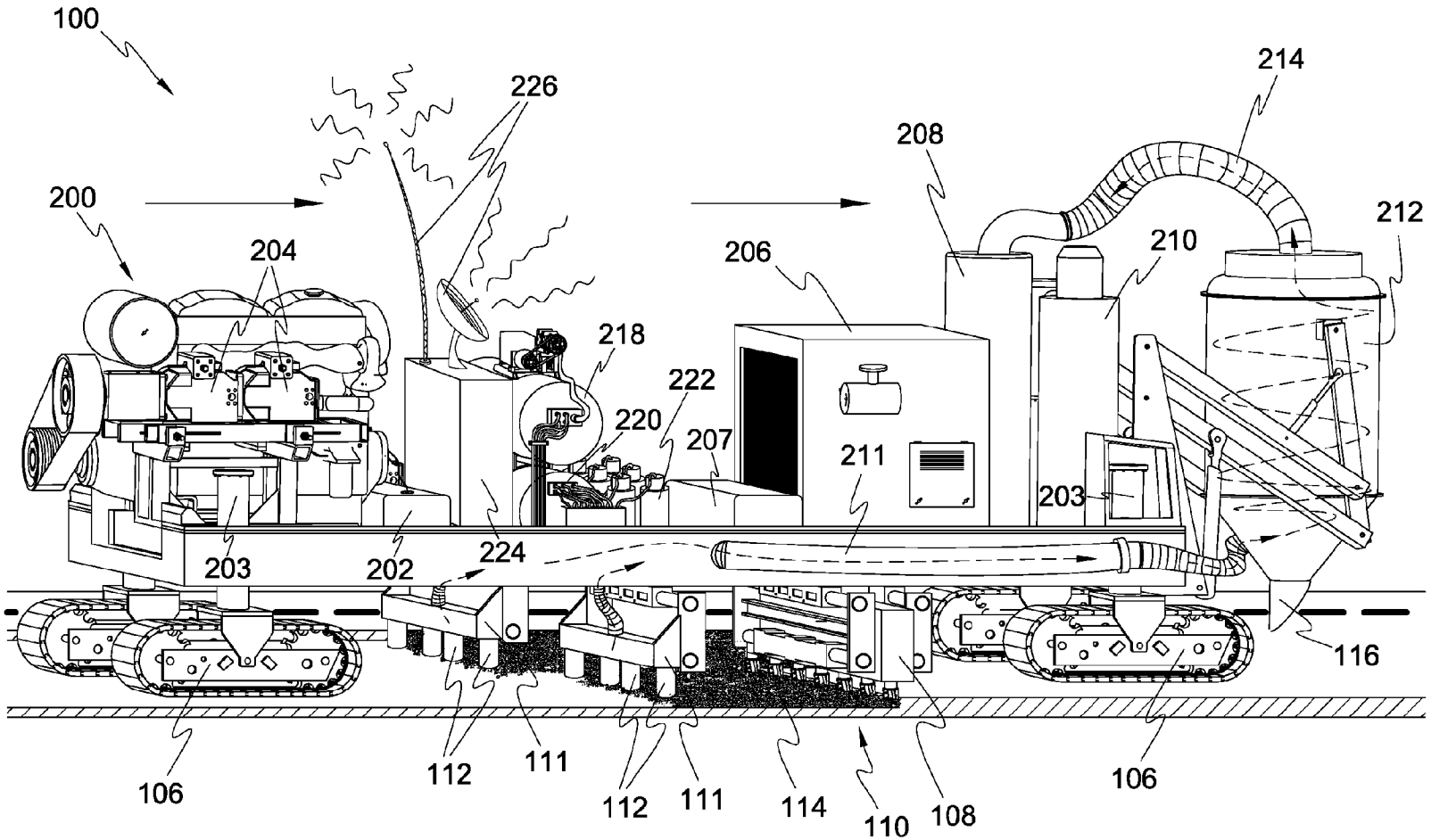
FIG. 2 is a perspective view of various internal components that may be included in a pavement degradation and removal apparatus in accordance with the invention.

Referring to FIG. 2, under the shroud 104, the apparatus 100 may include a variety of components to perform various features and functions. For example, in certain embodiments, the apparatus 100 may include an engine 200, such as a diesel or gasoline engine, to power the apparatus 100. The engine 200 may receive fuel from a fuel tank 202. In certain embodiments, the engine 200 may be used to drive one or more hydraulic pumps 204 which may drive hydraulic motors (not shown) for powering the translation mechanism 106. The hydraulic pumps 204 may also be used to drive one or more hydraulic cylinders 203, connected to the translation mechanism 106, for adjusting the level, slant, or elevation of the apparatus 100. The hydraulic pumps 204 may also be used to extend and retract the banks 108, 111 of degradation tools 110 using hydraulic cylinders or other hydraulic actuating mechanisms, and drive hydraulic motors used to rotate the individual pavement degradation tools 110.

Another engine 206 (here shown in an enclosed housing 206), and corresponding fuel tank 207, may be used to power a vacuum system to draw in the pavement fragments 114 generated by the pavement degradation tools 110. In selected embodiments, the vacuum system may include a filter 208, a silencer 210 or muffler 210, and a separator 212 such as a cyclone separator. In operation, the vacuum device may create a powerful air flow through the vacuum intake channels 112 to suck pavement fragments 114 into a cyclone separator 212 through one or more channels 211. When the incoming air stream and pavement fragments enter the cyclone separator 212, they spiral around the cylinder 212. The centrifugal force generated by this spiral propels the pavement fragments 114 outward and out of the air stream, thereby causing the pavement fragments 114 to fall downward through the separator 212 and the outlet 116. The airflow, and any remaining dust or particles mixed with the airflow, may be sucked through a channel 214 and into a filter 208 to filter out the remaining dust or particles. A silencer 210 or muffler 210 may be included to reduce the noise generated by the vacuum system.

In selected embodiments, the apparatus 100 may include an air compressor 218 to provide various function, including but not limited to providing positive air pressure to selected embodiments of a vacuum device (as will be described with additional specificity in the description associated with FIG. 9), powering pneumatic devices, providing pressurized air to clear debris from the area proximate the pavement degradation tools 110, or the like. Similarly, the apparatus 100 may include one or more tanks 220 to store hydraulic fluid and additional hydraulic pumps 222 to extend or retract the banks 108, 111, power the pavement degradation tools 110, or the like. In other embodiments, the apparatus 100 may include a computer or other electronic equipment 224 to control the apparatus 100, and to communicate with various remote sources, including but not limited to radio, satellite, cellular, Internet, web pages, caches, or other sources. In selected embodiments, the computer and electronic equipment 224 may communicate wirelessly with these remote sources by way of one or more antennas 226. Such a system may permit the apparatus 100 to be controlled or monitored remotely, or allow data to be uploaded or downloaded to the apparatus 100 as needed. Further updates for the software or executable code used in the computer or other electronic equipment 224 may also be remotely downloaded.

Figure 3:
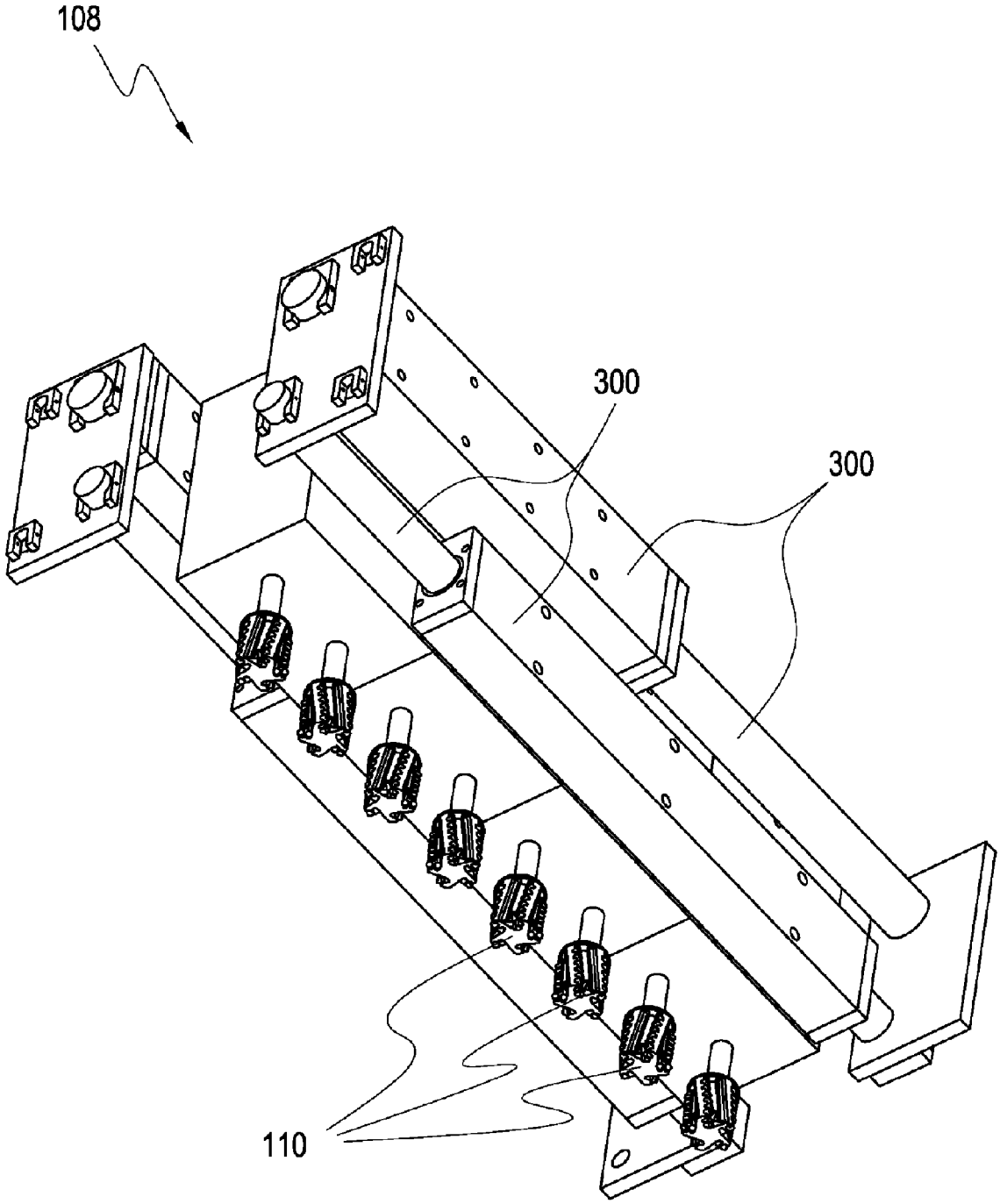
FIG. 3 is a perspective view of one embodiment of a bank of pavement degradation tools.

Referring to FIG. 3, a bank 108 may include one or more degradation tools 110. The pavement degradation tools 110 may be grouped together in banks 108 to allow the tools 110 to degrade a wider area than would be possible using any tool 110 individually, and to allow the tools 110 to share a common power source. The pavement degradation tools 110 may be mechanically linked together with gears (not shown) such that rotation of one causes the rotation of the other. These gears, if uniform in size, may allow the tools 110 to rotate at a uniform speed. In selected embodiments, the banks 108 may employ various hydraulic cylinders 300 to extend and retract the banks 108 with respect to the apparatus 100.

For a detailed description of the pavement degradation tools 110, the reader is referred to U.S. patent application Ser. No. 11/070,411 and entitled "Apparatus, System, and Method for Directional Degradation of a Paved Surface," having common inventors with the present invention. In general, each of the pavement degradation tools 110 may include a helically grooved tool body which may be constructed of various materials such as high-strength steel, hardened alloys, metal carbides, cemented metal carbide, or other suitable material known to those in the art. In certain embodiments, the tool body may also include a surface coating such as ceramic, steel, ceramic-steel composite, steel alloy, bronze alloy, tungsten carbide, polycrystalline diamond, cubic boron nitride, or other heat-tolerant, wear-resistant surface coating known to those in the art. The tool body may also, in certain embodiments, receive an anti-balling treatment for degrading sticky or tacky pavement materials.

Degradation inserts may be coupled to the tool body to make contact with and degrade pavement. In certain embodiments, various degradation inserts near the bottom of the tool 110 may be tilted downward to allow the tool 110 to vertically plunge into the pavement. The tool 110 may then be in position to degrade the pavement in a direction normal to the tool's axis of rotation using degradation inserts along the outer circumference of the tool 110.

The degradation inserts may include a cutting material, to directly contact the pavement, bonded to an underlying substrate. The substrate and cutting material may be arranged in two or more layers. The substrate may be manufactured from a material such as tungsten carbide, high-strength steel, or other suitable material known to those skilled in the art. The cutting material may include natural diamond, synthetic diamond, polycrystalline diamond, cubic boron nitride, a composite material, or other suitable material known to those in the art. The cutting material may be composed of smaller crystals or pieces that may vary in size to promote wear resistance, impact resistance, or both. In certain embodiments, to manage heat that may be present while degrading pavement, the cutting material may comprise thermally stable polycrystalline diamond or partially thermally stable polycrystalline diamond.

Figure 4:
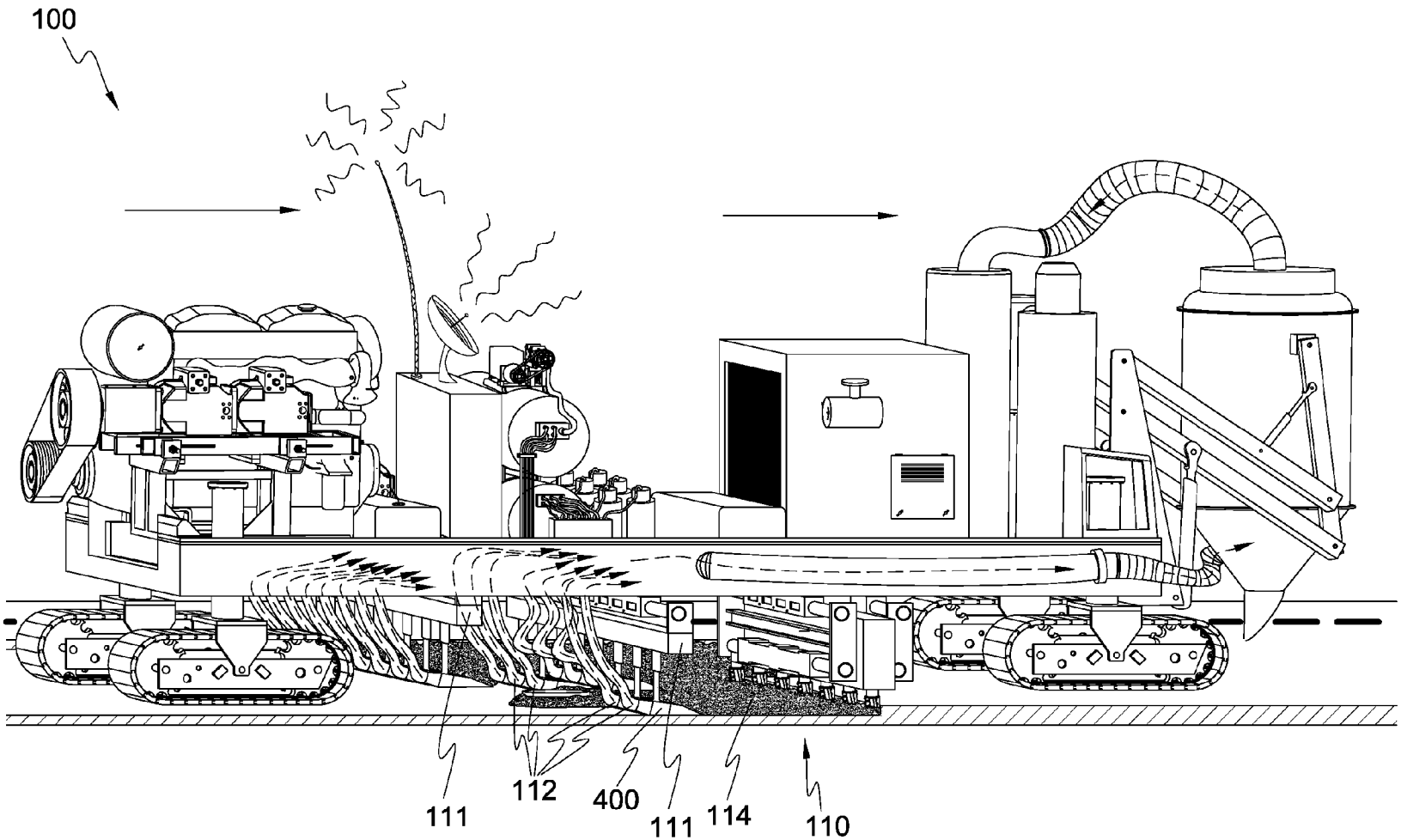
FIG. 4 is a perspective view of one embodiment of a scoop element that may be used in combination with a vacuum device to remove pavement fragments from a road surface.
Figure 5:
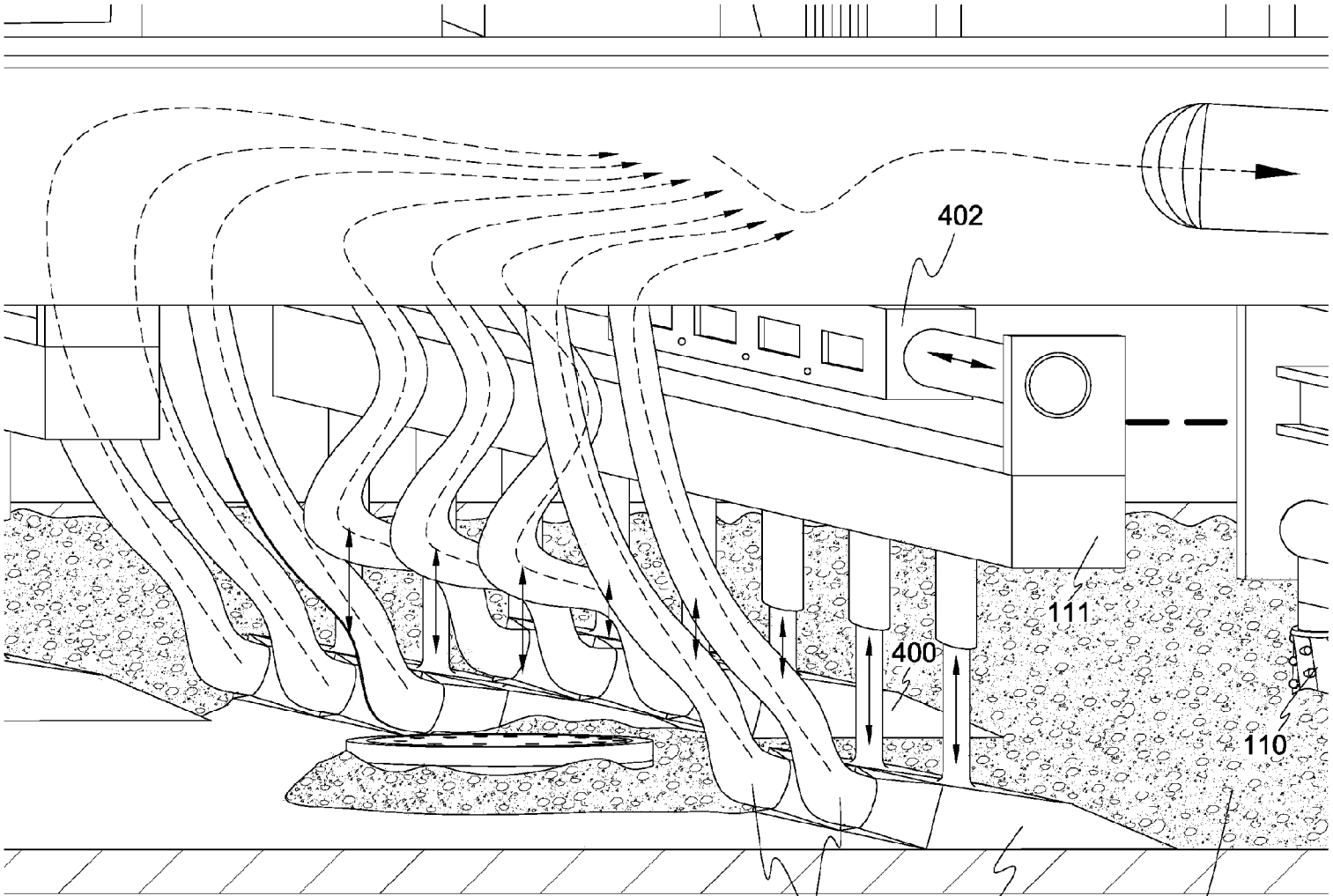
FIG. 5 is close-up perspective view of the scoop element of FIG. 4.

Referring to FIGS. 4 and 5, in selected embodiments, the apparatus 100 may include one or more scoop elements 400 to assist the vacuum device in removing pavement fragments 114 from the road surface. As the apparatus 100 moves forward, the scoop elements 400 may follow the pavement degradation tools 110 and scoop pavement fragments 114 into one or more vacuum intake channels 112. In selected embodiments, each of the scoop elements 400 may be independently raised or lowered by hydraulic or other means to avoid obstacles in the road, such as manholes, curbs, or the like. To accommodate the vertical movement of the scoop elements 400, the intake channels 112 may be constructed of a compliant material to flex in response to movement of the scoop elements 400.

In selected embodiments, the vertical movement of the scoop elements 400 may be controlled manually or automatically in response to feedback from sensors located on the apparatus 100. For example, various sensors located around the apparatus 100 may be configured to sense the presence of manholes, culverts, grates, or other obstacles. In response, selected scoop elements 400 could be raised to avoid these obstacles. The scoop elements 400 may be connected to one or more banks 111, actuated by hydraulic cylinders 402 or other means, to extend the scoop elements 400 in a transverse direction with respect to the apparatus 100.

Figure 6:
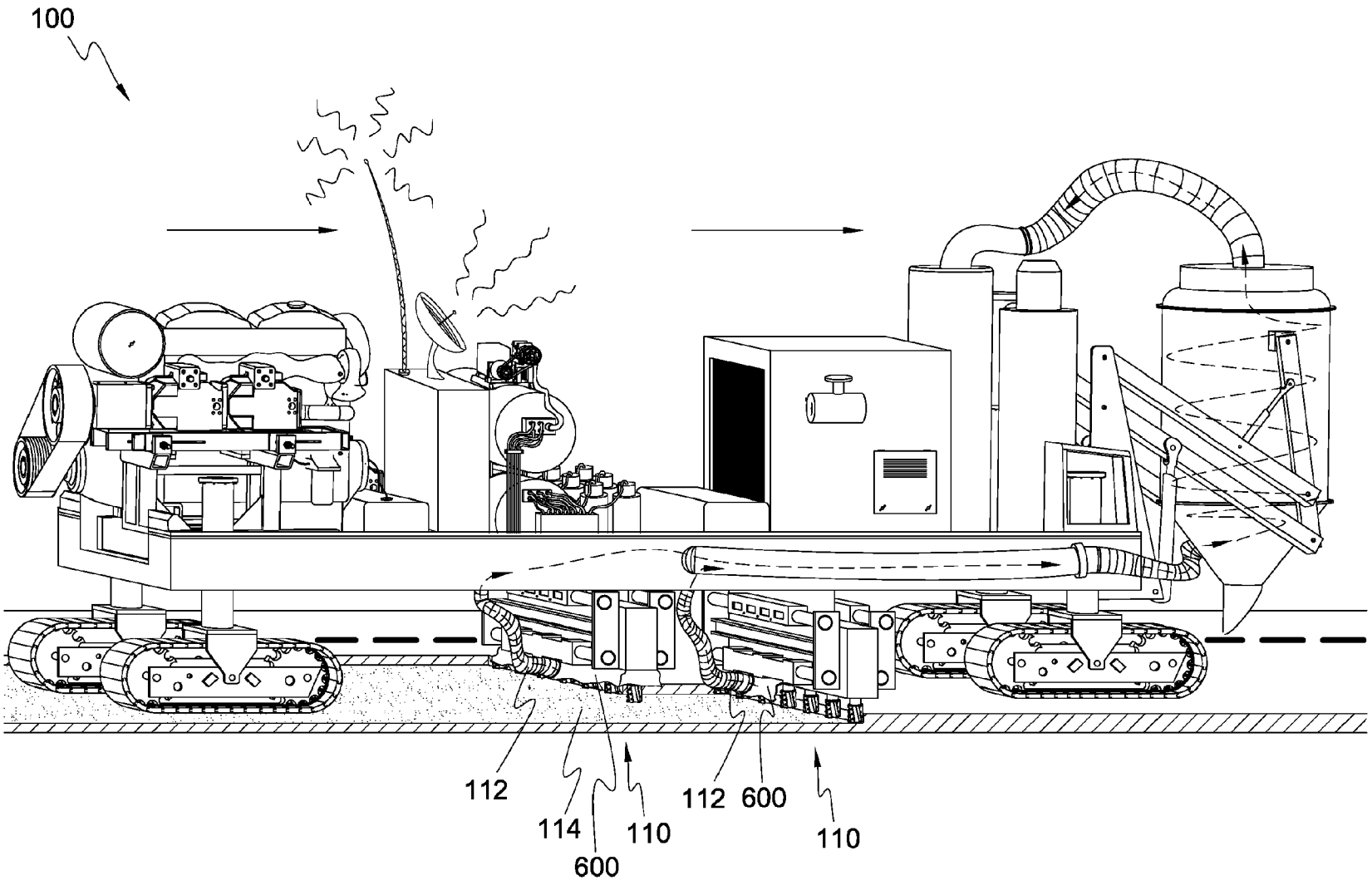
FIG. 6 is a perspective view of one embodiment of shrouds used to surround the pavement degradation tools.

Referring to FIG. 6, in another embodiment, one or more shrouds 600 may be used to encompass the pavement degradation tools 110. The shrouds 600 may be constructed of a flexible sheet-like material to conform to the surface of the road. One or more vacuum intake channels 112 may be connected to the shrouds 600. The shrouds 600 may be used to improve the vacuum seal between the pavement fragments 114 and the intake channels 112, thereby increasing the amount of suction exerted on the pavement fragments 114.

The use of shrouds 600 may provide several other advantages as well. For example, by placing the shrouds 600 around the pavement degradation tools 110, pavement fragments 114 may be removed from the road surface almost immediately upon creation. This may reduce the amount of dust and particles generated by the pavement degradation tools 110 and may actually aid in the degradation process by allowing the pavement degradation tools 110 to cut into virgin pavement, rather than into previously dislodged pavement fragments 114. Furthermore, the air flow generated by the vacuum may aid in cooling the pavement degradation tools 110. Finally, combining the vacuum intake channels 112 and the pavement degradation tools 110 into a single bank eliminates the need for separate banks 108, 111 of vacuum intake channels 112 and pavement degradation tools 110, as illustrated in FIGS. 1 and 2.

Figure 7:
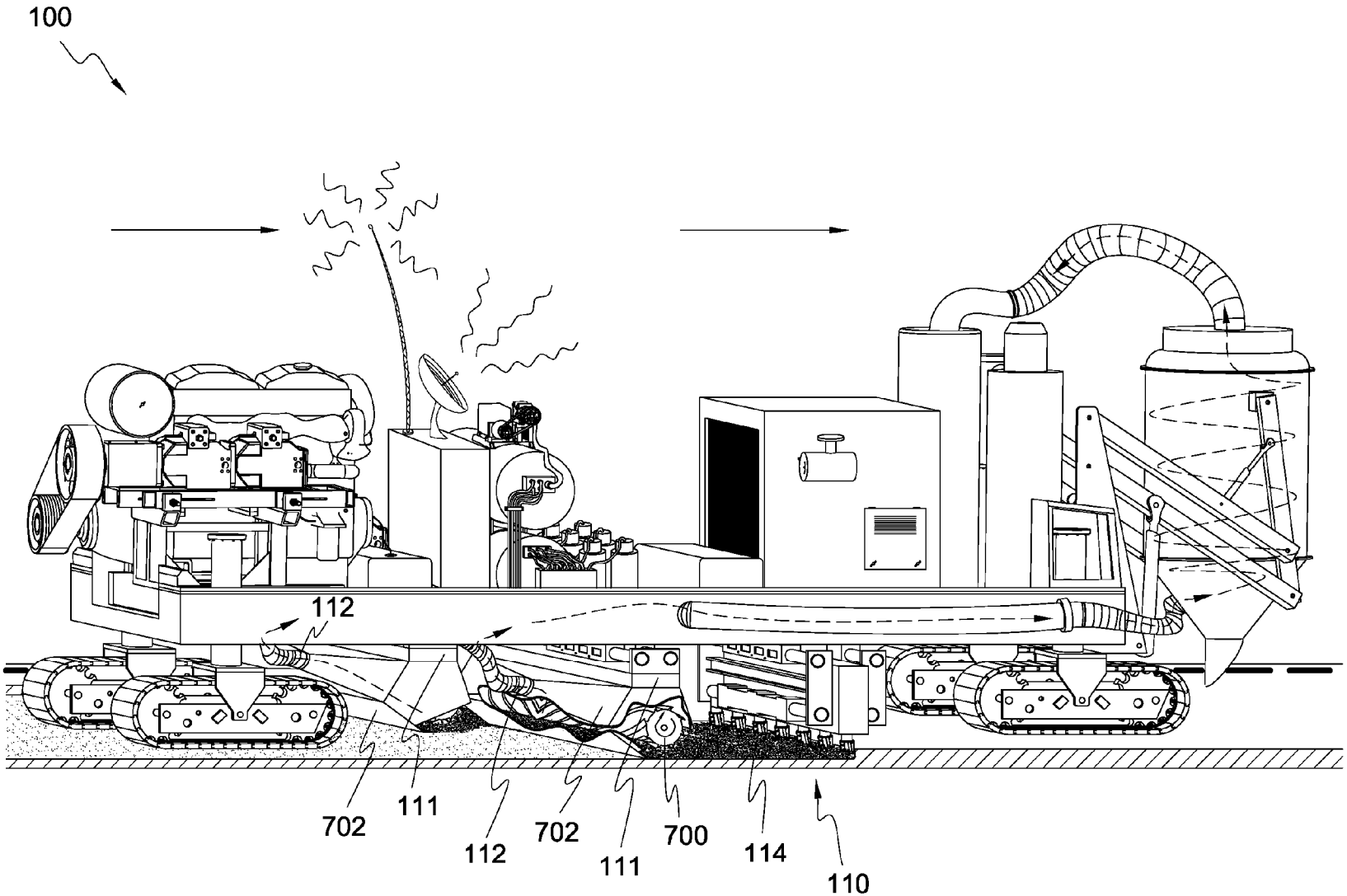
FIG. 7 is a perspective view of one embodiment of a roller comprising a series of vanes used to direct the pavement fragments into vacuum intake channels.

Referring to FIG. 7, in another embodiment, a vacuum device may employ one or more banks 111 of rollers 700. Vanes, paddles, or the like may be incorporated into the rollers 700 and may be used to scoop or direct pavement fragments 114 from the road surface into the vacuum intake channels 112. The rollers 700 may be encased in a shroud 702 or cover 702 having an opening to exert suction on the pavement fragments 114 and to aid in directing the pavement fragments 114 into the intake channels 112. The shroud 702 may also provide a structural framework to support the ends of the rollers 700, thereby providing an axis of rotation. In selected embodiments, the rollers 700 may be powered by hydraulic or other motors.

Figure 8:
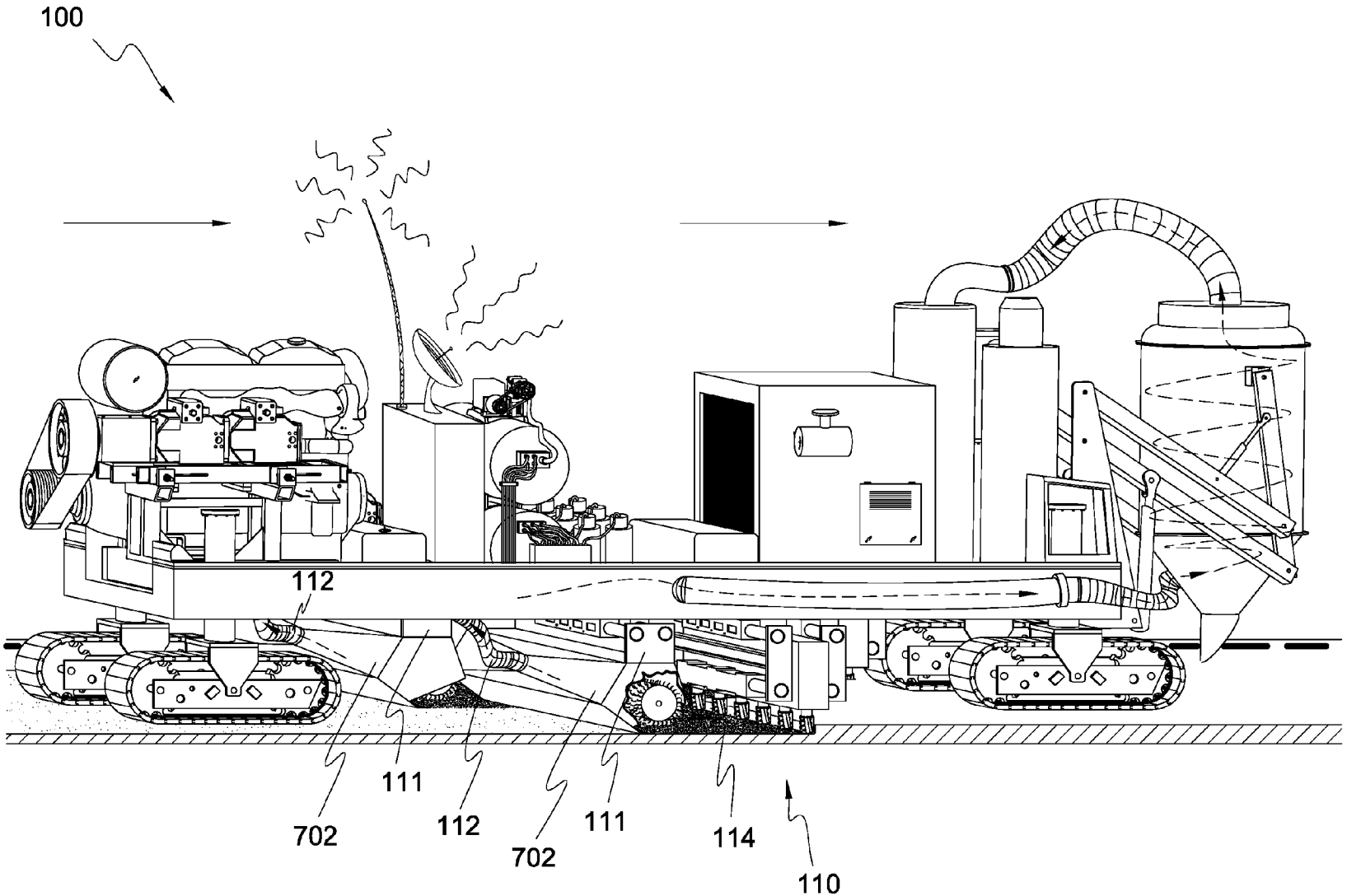
FIG. 8 is a perspective view of one embodiment of a bristled roller adapted to brush the pavement fragments into the vacuum intake channels.

Referring to FIG. 8, in another embodiment, a vacuum device may employ one or more banks 111 of bristled rollers 700. As the apparatus 100 moves forward, the bristled rollers 700 may be configured to rotate over the pavement fragments 114 and direct them into the vacuum intake channels 112. A bristled roller 700 may also be effective at avoiding or simply rolling over and conforming to obstacles in the roadway. Like the previous example, the bristled rollers 700 may be encased in a shroud 702 to channel the air flow over the pavement fragments 114 and to aid in directing the pavement fragments 114 into the intake channels 112. Similarly, the bristled rollers 700 may be powered by hydraulic or other suitable types of motors.

Figure 9:
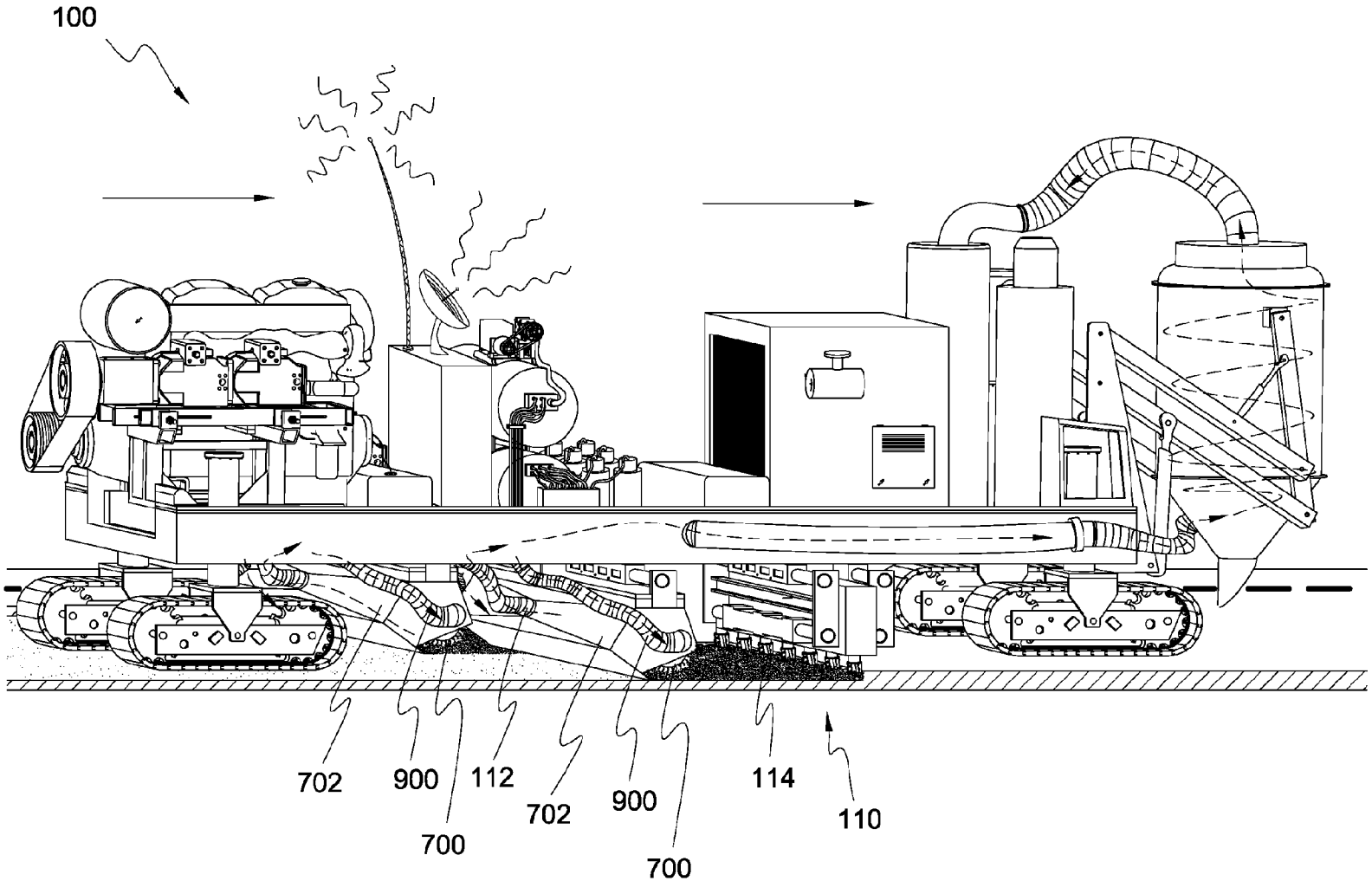
FIG. 9 is a perspective view of one embodiment of various input channels to provide positive pressure inside a shroud.

Referring to FIG. 9, in selected embodiments, one or more input channels 900 may be used provide positive pressure inside the shrouds 702. An air compressor, a fan, an output of the vacuum device, or other source may be used to direct air flow through the input channels 900 where it may enter ports in the shrouds 702. The positive air flow may be used to clear the pavement fragments from the rollers 700 and direct them into the vacuum intake channels 112. The strength of the air flow traveling between these channels 900, 112 may be sufficient to carry the pavement fragments 114 through the vacuum system.

Figure 10:
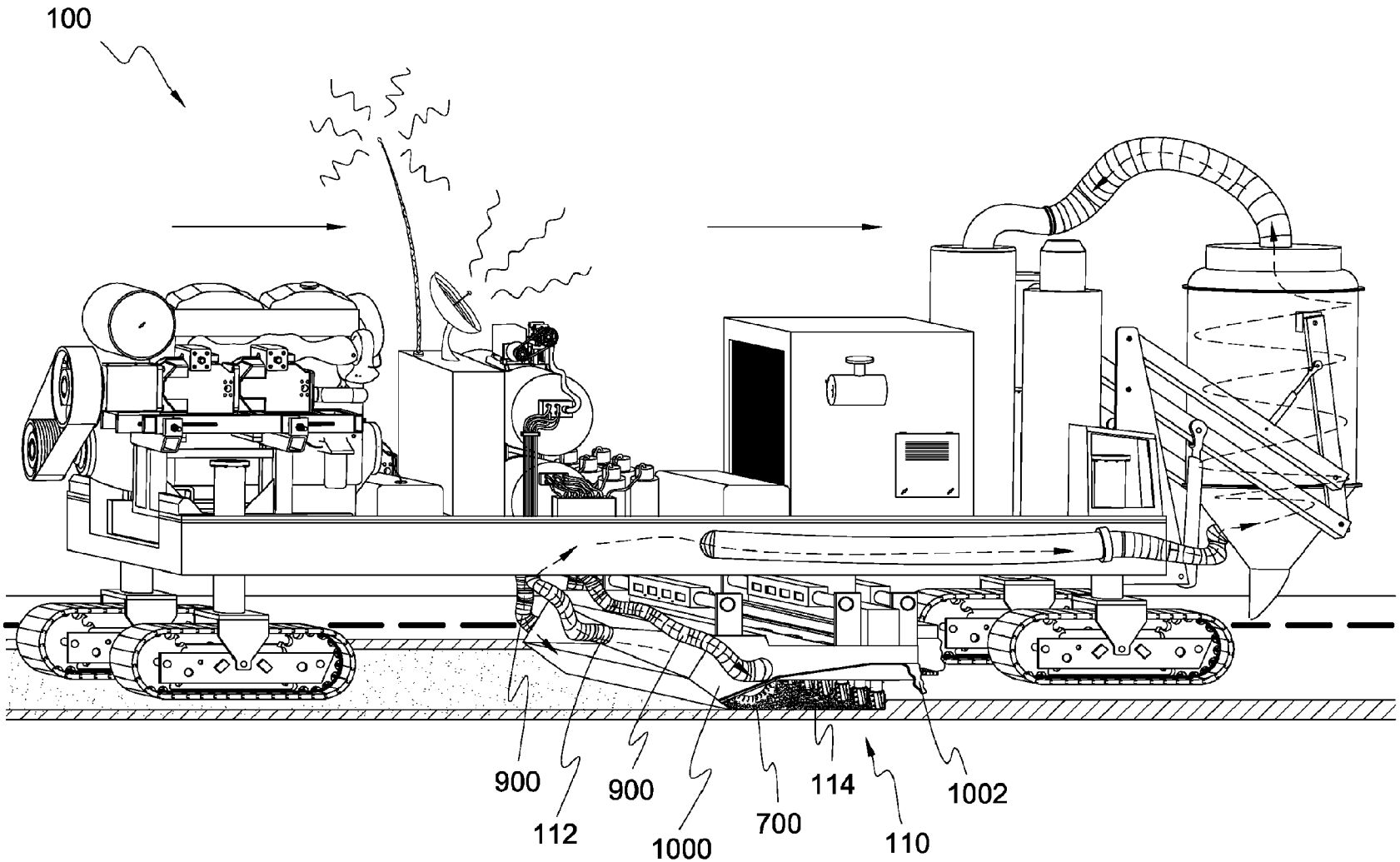
FIG. 10 is a perspective view of one embodiment of a shroud used to cover a bristled roller and the pavement degradation tools.

Referring to FIG. 10, in yet another embodiment, a single shroud 1000 may be used to cover both a roller 700 and pavement degradation tools 110. In selected embodiments, the shroud 1000 may include a flexible sheet-like material 1002 (shown cutaway) that extends over the pavement degradation tools 110 and conforms to the surface of the road. As previously explained, the shroud 1000 may improve the vacuum seal between the pavement fragments 114 and the intake channel 112, thereby increasing the section exerted on the pavement fragments 114. Furthermore, the shroud 1000 may reduce the amount of dust generated by the degradation tools 110 and aid in cooling the pavement degradation tools 110. This embodiment may also eliminate the need for separate banks 108, 111 of rollers 700 and pavement degradation tools 110, as illustrated in FIG. 9. In selected embodiments, positive air flow may be introduced inside the shroud 1000 through one or more input channels 900. This positive air flow may aid in clearing pavement fragments 114 from the roller 700 and directing them into the vacuum intake channel 112.

Figure 11:
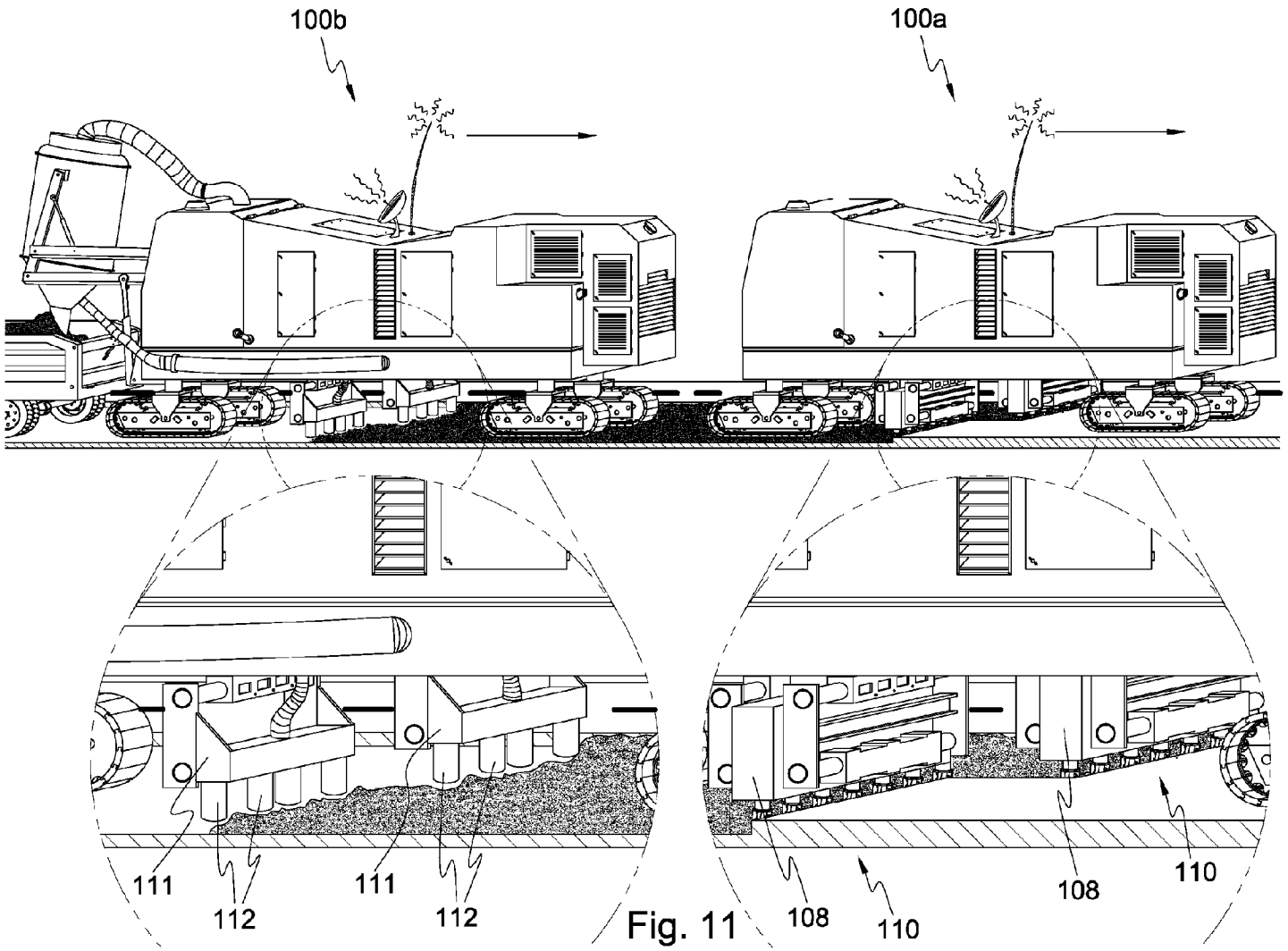
FIG. 11 is a perspective view of one embodiment of a multi-vehicle system for degrading and removing a paved surface.

Referring to FIG. 11, in selected embodiments, the pavement degradation tools 110 and the vacuum devices illustrated with respect to FIG. 1 through 10 may be located on separate vehicles. For example, one or more banks 108 of degradation tools 110 may be placed on a first vehicle 100*a*. Similarly, one or more banks 111 of vacuum intake channels 112 may be placed on a second vehicle 100*b*, following the first vehicle 100*a*. The use of separate vehicles may provide additional versatility. For example, the vehicle 100*a* may be more useful in applications where the pavement fragments 114 are not removed from the road surface, such as in applications where the pavements fragments 114 are recycled in situ. Similarly, the vehicle 100*b* may be used in a wide variety of vacuuming applications, rather than solely for removing pavement fragments 114 generated by the pavement degradation tools 110.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

What is claimed is:

1. An apparatus for degrading and removing a paved surface, the apparatus comprising:

a vehicle for traveling across a paved surface;

a pavement degradation tool coupled to the vehicle, the pavement degradation tool adapted to degrade the paved surface while rotating about an axis substantially normal to the paved surface; and a vacuum device comprising a plurality of independently movable intake channels is coupled to the vehicle and adapted to remove pavement fragments produced by the pavement degradation tool.

2. The apparatus of claim 1, wherein a plurality of intake channels are divided into a plurality of banks, wherein each bank is independently moveable.

3. The apparatus of claim 1, further comprising a shroud operably connected to the plurality of intake channels, wherein the shroud is adapted to improve the vacuum seal between the pavement fragments and the at least one intake channel.

4. The apparatus of claim 3, wherein the shroud covers the pavement degradation tool.

5. The apparatus of claim 3, further comprising an input channel to provide positive pressure inside the shroud.

6. The apparatus of claim 1, wherein the vacuum device further comprises a scoop element to scoop the pavement fragments into the plurality of intake channels.

7. The apparatus of claim 1, wherein the vacuum device comprises a roller to rotate over the pavement fragments, the roller comprising a series of vanes to direct the pavement fragments into the plurality of intake channels.

8. The apparatus of claim 1, wherein the vacuum device comprises a bristled roller to rotate over the pavement fragments, the bristled roller adapted to brush the pavement fragments into the plurality of intake channels.

9. The apparatus of claim 1, wherein the vacuum device comprises a separator to extract the pavement fragments fmm the air stream traveling thnzugh the plurality of intake channels.

10. A method for degrading and removing a paved surface, the method comprising:

directing a pavement degradation tool across a paved surface, the pavement degradation tool adapted to degrade the paved surface while rotating about an axis substantially normal to the paved surface; and removing pavement fragments produced by the pavement degradation tool using a vacuum device comprising a plurality of independently movable intake channels.

* * * * *